US011850710B2

(12) United States Patent
Sano et al.

(10) Patent No.: US 11,850,710 B2
(45) Date of Patent: Dec. 26, 2023

(54) IMPACT WRENCH

(71) Applicant: MAKITA CORPORATION, Anjo (JP)

(72) Inventors: Yuya Sano, Anjo (JP); Yuki Murai, Anjo (JP); Nobuaki Shikata, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/464,958

(22) Filed: Sep. 2, 2021

(65) Prior Publication Data

US 2022/0111497 A1 Apr. 14, 2022

(30) Foreign Application Priority Data

Oct. 13, 2020 (JP) ..... 2020-172769

(51) Int. Cl.
*B25B 21/02* (2006.01)
*B25B 23/00* (2006.01)

(52) U.S. Cl.
CPC ..... *B25B 21/02* (2013.01); *B25B 23/0035* (2013.01)

(58) Field of Classification Search
CPC .... B25B 21/02; B25B 21/023; B25B 23/0035
USPC ..... 173/93.5
See application file for complete search history.

(56) References Cited

U.S. PATENT DOCUMENTS 2,256,496 A * 9/1941 Robinson ..... B25B 21/026 464/57
6,938,526 B2 9/2005 Milbourne et al.
2005/0022638 A1* 2/2005 Milbourne ..... B25B 21/026 81/466
2008/0087448 A1* 4/2008 Happ ..... B25B 21/023 173/93
2008/0292419 A1* 11/2008 Hild ..... B23B 31/1071 408/239 R
2011/0056714 A1* 3/2011 Elger ..... B25B 21/02 173/128
2013/0154202 A1* 6/2013 Low ..... B25B 23/0035 279/9.1
2021/0060741 A1* 3/2021 Kusumoto ..... B25B 21/026

FOREIGN PATENT DOCUMENTS

WO 2005011921 A1 2/2005

* cited by examiner

*Primary Examiner* — Anna K Kinsaul
*Assistant Examiner* — Luis G Del Valle
(74) *Attorney, Agent, or Firm* — J-TEK LAW PLLC; Jeffrey D. Tekanic; Scott T. Wakeman

(57) ABSTRACT

An impact wrench (1) includes: a brushless motor (11); a hammer (17) disposed frontward of, and driven by, the brushless motor; and a hammer case (16), which houses the hammer. An anvil (4) of the impact wrench includes: an arm portion (25) disposed frontward of the hammer and configured to be impacted (struck) in a rotational direction by the hammer; a cylindrical portion (30) connected to the arm portion and supported by the hammer case; a square-column portion (31) disposed frontward of the cylindrical portion; and an enlarged portion (35) disposed between the cylindrical portion and the square-column portion and enlarging in a direction extending rearward from the square-column portion. A recessed portion (37) is continuous in a circumferential direction of the cylindrical portion and is disposed between the cylindrical portion and the enlarged portion of the anvil.

20 Claims, 10 Drawing Sheets

IMPACT WRENCH

CROSS-REFERENCE

The present application claims priority to Japanese patent application serial number 2020-172769 filed on Oct. 13, 2020, the contents of which are incorporated fully herein by reference.

TECHNICAL FIELD

The present invention generally relates to a power tool, such as an impact wrench, in which impacts to an anvil, on which a socket is mounted, are repetitively generated (applied) in a rotational direction of the socket.

BACKGROUND ART

WO 2005/011921 discloses an impact wrench that comprises: a spindle (carrier), to which rotation from a motor is transmitted via a gear assembly; a hammer (impactor), which is coupled with the spindle via a cam and is biased forward by a coil spring; and an anvil, which is mounted within the hammer and protrudes forward. The anvil has a cylindrical portion (round body); a square-column portion (square drive head) is formed at the tip of the cylindrical portion. A socket is mounted on the square-column portion, and a bolt, a nut, or the like is fitted in the socket for tightening, e.g., in a workpiece. As the tightening progresses and the torque imparted to the anvil becomes high, the hammer repetitively engages with and disengages from (strikes) the anvil, and thereby repetitive impacts are generated in the rotational direction.

When an impact occurs in this impact wrench, the corner portions of the square-column portion of the anvil and the inner surfaces of a square hole of the socket strongly (forcibly) contact one another in the rotational direction, and thereby stress is generated in the anvil. Because this stress is concentrated particularly in the vicinity of the base of the square-column portion, which is the portion at which the shape transitions, there is a risk that, with use over the long term, breakage will occur in the vicinity of the base of the square-column portion.

SUMMARY OF THE INVENTION

However, even though the shape of the anvil disclosed in WO 2005/011921 was designed with the intention of reducing stress in the vicinity of the base of the square-column portion (square drive head), further improvements in stress reduction are desirable.

It is one, non-limiting object of the present teachings to disclose techniques for improving an impact wrench such that the durability of an anvil can be improved by more effectively alleviating stress in the vicinity of the base of a socket-mating portion such as a square-column portion (square drive head).

In one non-limiting aspect of the present teachings, an impact wrench comprises:

a motor;

a hammer, which is disposed frontward of the motor and rotates owing to the motor (in response to the motor being energized or is rotatable using rotational energy generated by the motor);

a hammer case, which houses the hammer; and an anvil comprising: an arm portion, which is disposed frontward of the hammer and is impacted in a rotational direction by the hammer; a cylindrical portion, which is connected to the arm portion and is supported by the hammer case; a socket-mating portion, which is disposed frontward of the cylindrical portion; and an enlarged portion, which is disposed between the cylindrical portion and the socket-mating portion and enlarges (is shaped such that it enlarges, flares or widens) as it goes (extends) rearward from the socket-mating portion;

wherein a recessed portion (groove), which is continuous in a circumferential direction of the cylindrical portion, is formed (defined) between the cylindrical portion and the enlarged portion of the anvil.

In another non-limiting aspect of the present teachings, an impact wrench comprises:

a motor;

a hammer, which is disposed frontward of the motor and rotates owing to the motor (in response to the motor being energized or is rotatable using rotational energy generated by the motor);

a hammer case, which houses the hammer; and an anvil comprising: an arm portion, which is disposed frontward of the hammer and is impacted in a rotational direction by the hammer; a cylindrical portion, which is connected to the arm portion and is supported by the hammer case; and a socket-mating portion, which is disposed frontward of the cylindrical portion;

wherein a first recessed portion (first groove), which is continuous in a circumferential direction of the cylindrical portion, and a second recessed portion (second groove), which is disposed rearward of the first recessed portion and is continuous in the circumferential direction, are formed (defined) between the cylindrical portion and the socket-mating portion of the anvil.

According to the present teachings, stress can be more effectively alleviated (reduced) in the vicinity of the base of a socket-mating portion and the durability of an anvil can be improved owing to the formation of one or more recessed portions (grooves) in the anvil.

DETAILED DESCRIPTION OF EMBODIMENTS OF THE PRESENT TEACHINGS

Embodiments of the present teachings will be explained below, with reference to the drawings.

Figure 1:
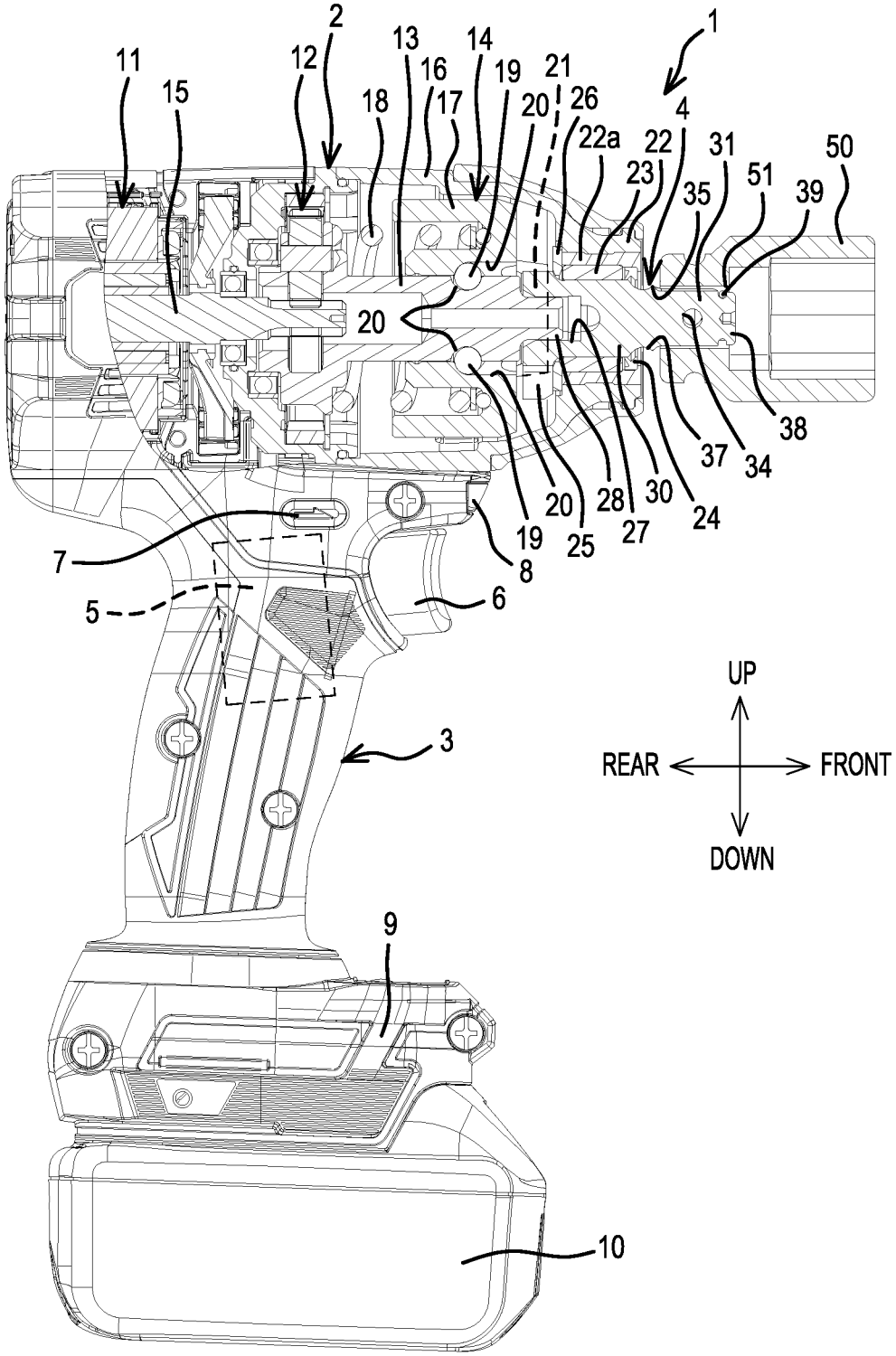
FIG. 1 is a partial, center, longitudinal cross-sectional view of an impact wrench according to a first representative, non-limiting embodiment of the present teachings.

FIG. 1 is a center, longitudinal cross-sectional view that shows one exemplary example of an impact wrench 1 according to the present teachings.

The impact wrench 1 comprises a main body 2 and a handle 3. The main body 2 extends in a front-rear direction, and the handle 3 extends downward away from the main body 2. A rear portion of an anvil 4 is housed in the interior of the main body 2. A front portion of the anvil 4 protrudes forward from a front end of the main body 2.

A switch 5, which causes a trigger 6 to protrude forward, is provided at an upper portion of the handle 3. A forward/reverse change button (reversing lever) 7, which changes the rotational direction of the anvil 4, is provided upward of the switch 5. A light 8, which illuminates forward of the anvil 4, is provided upward of the trigger 6. A battery-mounting portion 9 is formed at a lower end of the handle 3. A battery pack 10, which constitutes a power supply, is mounted on the battery-mounting portion 9. A controller (not shown) is housed inside the battery-mounting portion 9.

In order from the rear, a brushless motor 11, a speed-reducing mechanism 12, a spindle 13, and an impact mechanism 14 are provided inside the main body 2. The brushless motor 11 comprises a rotary shaft 15. The rotational speed of the rotary shaft 15 is reduced by the speed-reducing (torque-increasing) mechanism 12. The speed-reduced (torque-increased) rotation is transmitted to the spindle 13.

The impact mechanism 14 is housed inside a hammer case 16, which is provided in the front portion of the main body 2. The impact mechanism 14 comprises: a hammer 17, which is externally mounted on (around) the spindle 13, and a coil spring 18, which biases the hammer 17 forward.

The hammer 17 and the spindle 13 are coupled in the rotational direction by two balls 19, which are provided between the hammer 17 and the spindle 13. Two cam grooves 20, which the two balls 19 respectively extend into and mate with, are formed (defined) on each of an inner-circumferential surface of the hammer 17 and an outer-circumferential surface of the spindle 13. The coil spring 18 is externally mounted on (around) the spindle 13 and biases the hammer 17 forward. The hammer 17 comprises a pair of tabs 21 on its front surface.

The anvil 4 is supported by a front-tube portion 22 of the hammer case 16. The hammer case 16 is made of aluminum. An insert bushing 22*a*, which is made of iron, is formed on the front-tube portion 22 by insert molding. Thereby, the insert bushing 22*a* is rigidly fixed to the hammer case 16. A metal bearing 23 is press fitted into the insert bushing 22*a*. The metal bearing 23 supports the anvil 4 coaxially with the spindle 13. By virtue of the metal bearing 23 being press fitted in the insert bushing 22*a*, the anvil 4 can be held relative to the hammer case 16, even if the width (axial length) of the insert bushing 22*a* is small. An oil seal 24 is disposed forward of the metal bearing 23. The oil seal 24 inhibits (blocks) leakage of grease outward from the interior of the hammer case 16.

A pair of arm portions 25 is radially formed at a rear end of the anvil 4; i.e. the arm portions 25 each extend radially from the anvil 4. The arm portions 25 respectively engage, in the rotational direction, with the tabs 21 of the hammer 17. Although the present embodiment has two arm portions 25, there may be three or more of the arm portions 25 and three or more of the tabs 21, or there may be only one arm portion 25 and only one tab 21. A restricting (positioning) washer 26 is provided between the front-tube portion 22 and the arm portions 25. The anvil 4 is positioned in the forward direction by the restricting washer 26. A bottomed hole (blind hole) 27 is formed in the axial center of the anvil 4 and extends frontward from a rear end of the anvil 4. A small-diameter portion 28, which is provided at a front end of the spindle 13, is inserted into the rear end of the bottomed hole 27.

Figure 2:
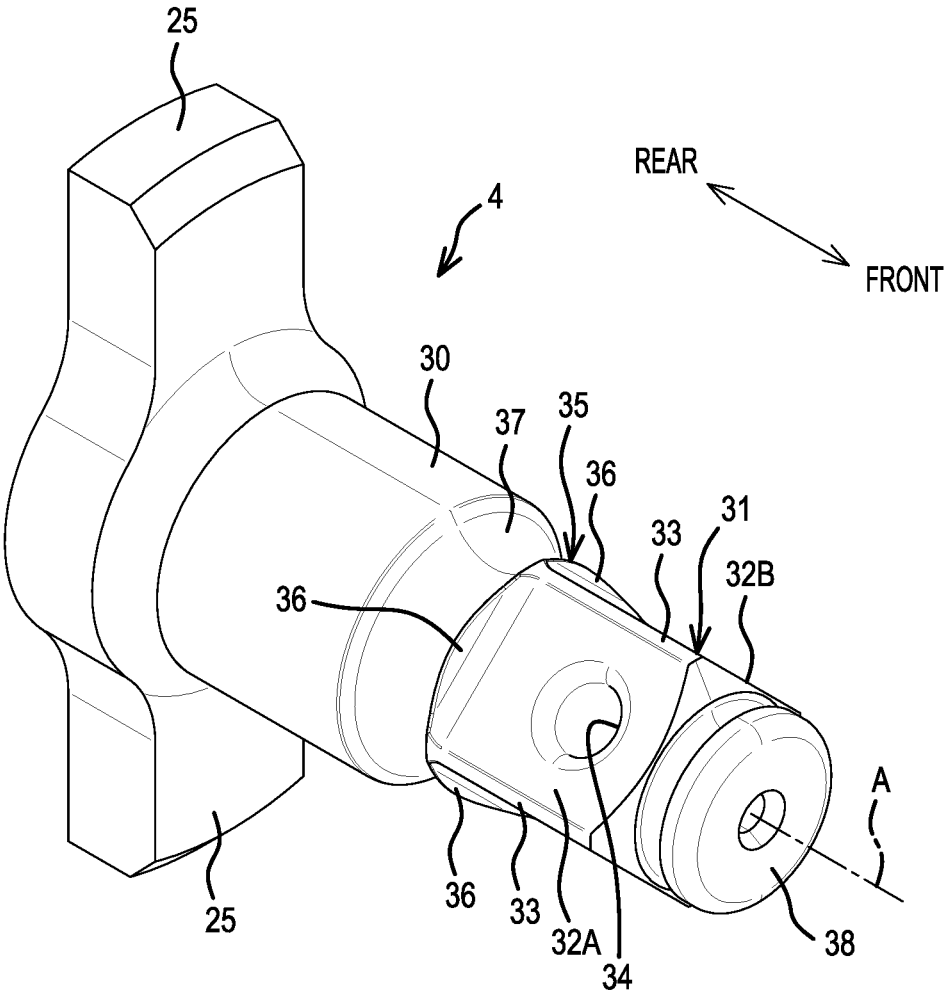
FIG. 2 is an oblique view of an anvil of the impact wrench shown in FIG. 1.

FIG. 2 shows an oblique view, from the front, of the anvil 4. In the anvil 4, a cylindrical portion 30, which has a circular shape in a transverse cross section, is disposed forward of the arm portions 25. A square-column portion (square drive head) 31 is provided forward of the cylindrical portion 30. The square-column portion 31 has a cross-section orthogonal to rotational axis A of the anvil 4 that is at least substantially square shaped. The square-column portion 31 has four side surfaces 32A, 32B, 32C, 32D; four corner portions 33 are respectively located between adjacent ones of the side surfaces 32A-32D. These corner portions 33 may also be referred to as "chamfered" edges.

A socket 50, which has a square hole 51 whose transverse cross section is at least substantially square shaped, is detachably (removably) mounted on the square-column portion 31. A through hole 34 is formed, orthogonally to the side surfaces 32A, 32C, such that it passes through the square-column portion 31. The through hole 34 is provided for the purpose of passing a retainer pin of the socket 50 therethrough.

An enlarged portion 35 is formed rearward of the square-column portion 31. The enlarged portion 35 consists of four tongues 36, which respectively extend rearward from the rear ends of the four side surfaces 32A-32D of the square-column portion 31. Each of the tongues 36 (i.e. the diameter or length in the radial direction thereof) widens (enlarges or flares), as it goes (extends) rearward, in a curved-surface shape outward in the radial direction of the anvil 4, and the tongues 32A-32D may sometimes be referred to as "flared tongues." The outer shape (contour) of the rear end of each of the tongues 36 is an arcuate shape in front view. The enlarged portion 35 serves as a stopper that restricts (blocks) movement of the socket 50 rearward.

Figure 3C:
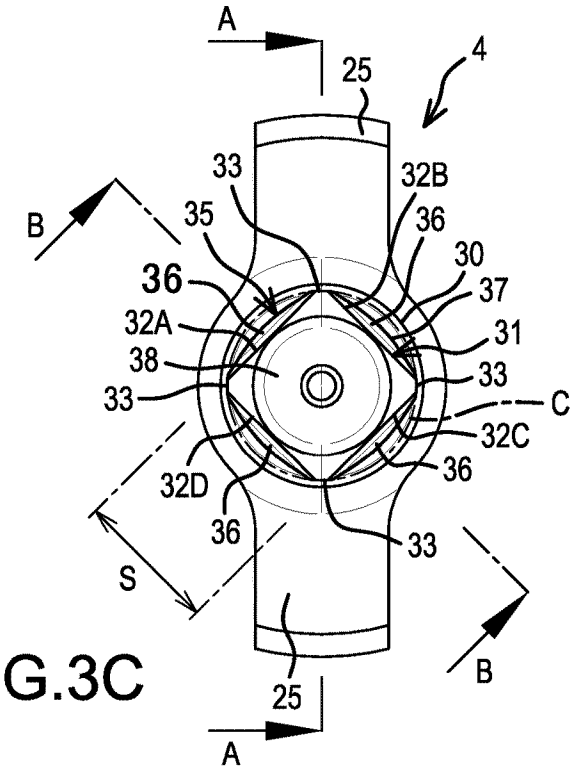
FIG. 3C is a front view thereof.
Figure 3B:
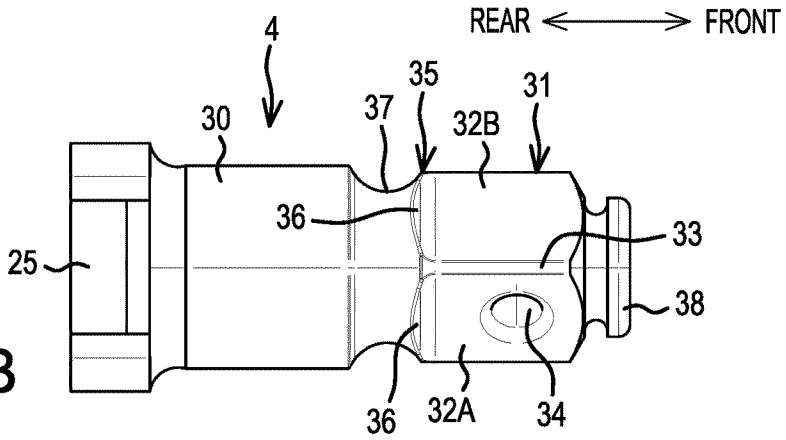
FIG. 3B is a plan view thereof.
Figure 3A:
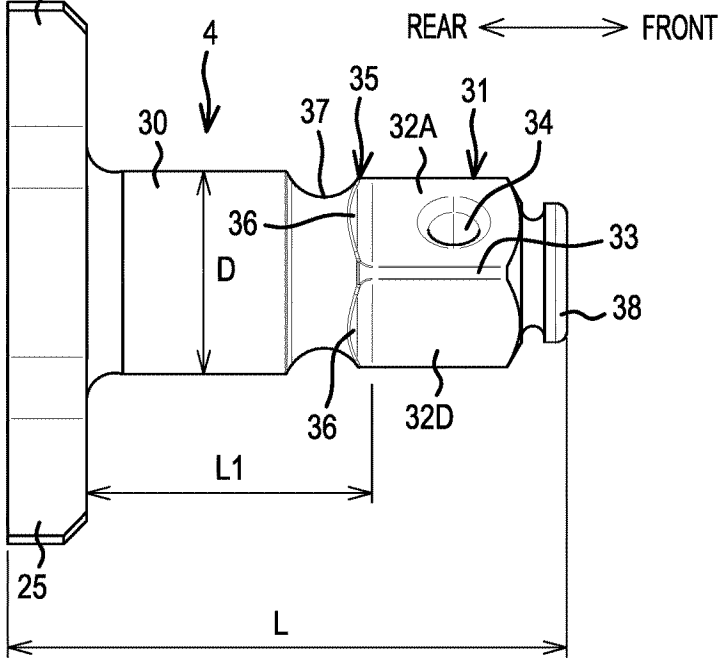
FIG. 3A is a side view of the anvil.
Figure 4A:
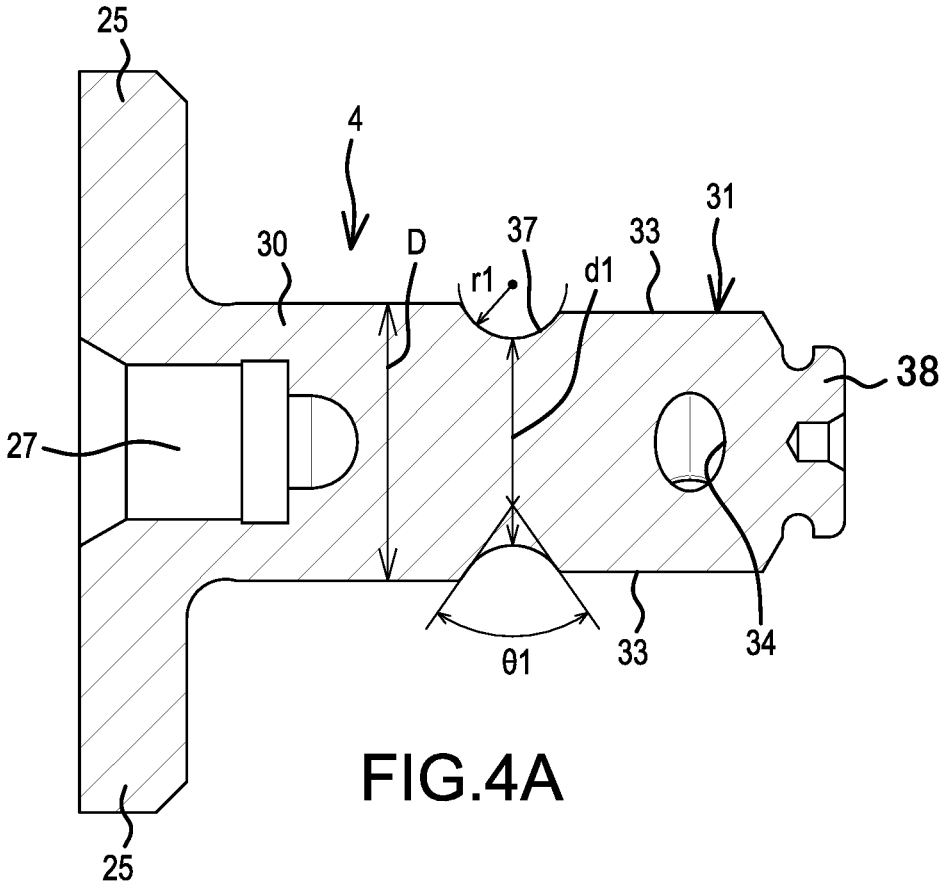
FIG. 4A is a cross-sectional view taken along line A-A in FIG. 3C.
Figure 4B:
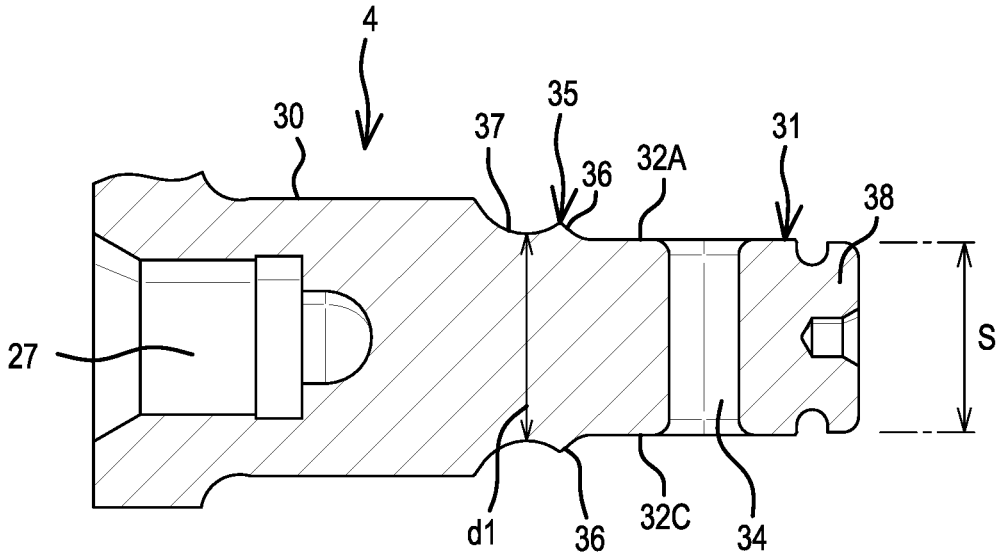
FIG. 4B is a cross-sectional view taken along line B-B.
Figure 5:
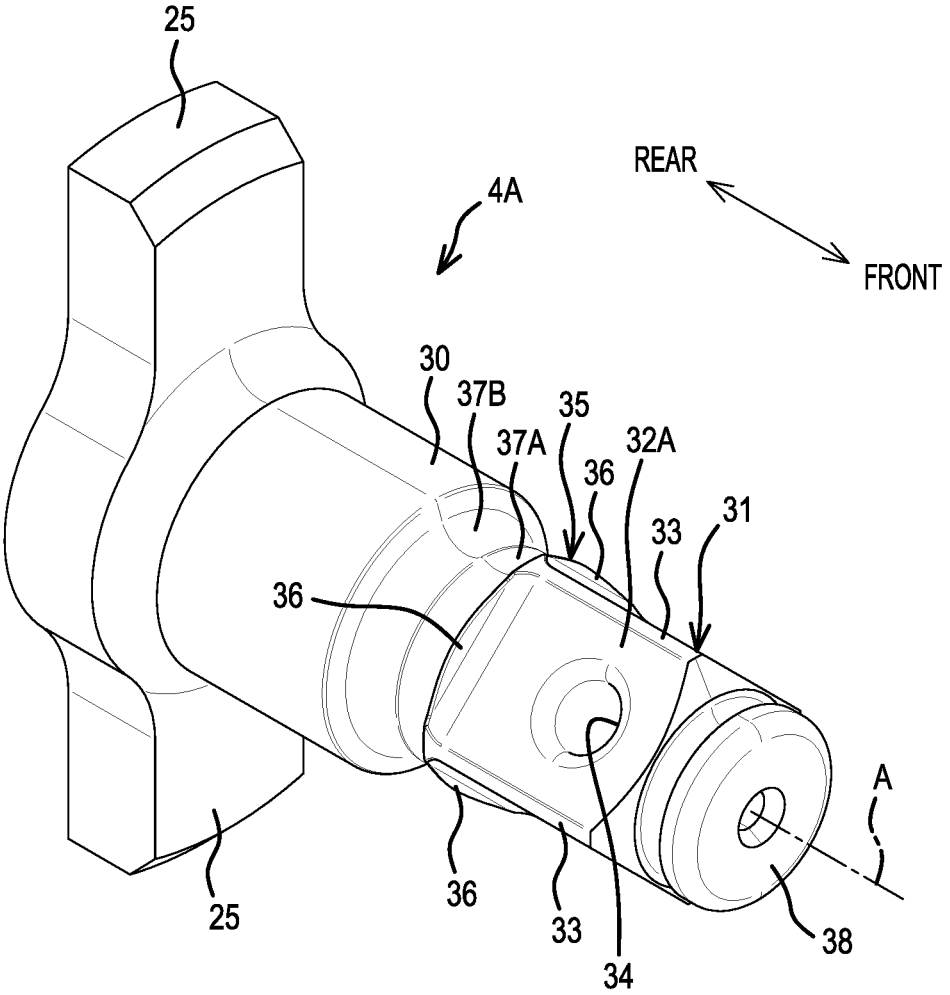
FIG. 5 is an oblique view of an anvil according to a modified example.
Figure 6C:
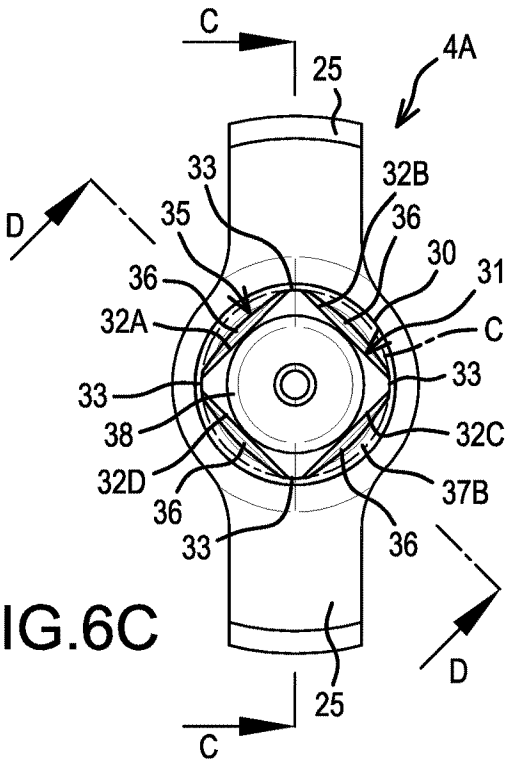
FIG. 6C is a front view thereof.
Figure 6B:
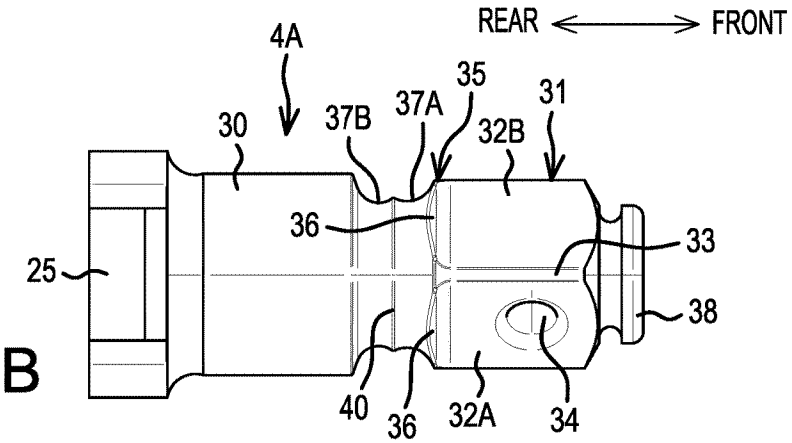
FIG. 6B is a plan view thereof.
Figure 6A:
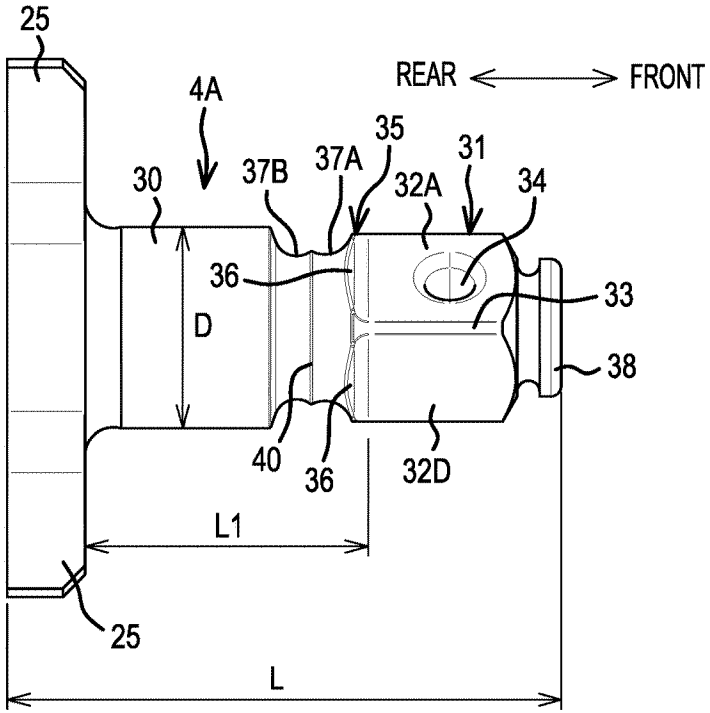
FIG. 6A is a side view of the anvil according to the modified example.

Rearward of the enlarged portion 35, a recessed portion (circumferential groove) 37 is formed (defined) between the enlarged portion 35 and the cylindrical portion 30. The recessed portion 37 has a ring shape that is continuous in the circumferential direction of the cylindrical portion 30, and may sometimes be referred to as a "ring-shaped channel" As shown in FIG. 3 and FIG. 4, the transverse-cross-sectional shape of the recessed portion 37 is a semicircular shape having a radius r1. The recessed portion 37 is formed such that the diameter d1 of the deepest portion of the recessed portion 37 is slightly larger than the spacing S (across-flats distance) between the side surfaces 32A, 32C of the square-column portion 31, which are parallel to each other. In addition, the recessed portion 37 is formed such that the diameter d1 is smaller than the diameter of the circumscribed circle C of the square-column portion 31 that is shown in FIG. 3C.

The groove angle θ1 (FIG. 4A) of the recessed portion 37, which groove angle θ1 is formed by two tangents that respectively pass through the front-end edge and the rear-end edge of the transverse cross section, is less than 90°.

The front end of the bottomed hole 27 in the rear portion of the anvil 4 stops (ends) inside the cylindrical portion 30, and the length of the bottomed hole 27 does not reach the recessed portion 37. That is, because the bottomed hole 27 does not overlap the recessed portion 37 of the anvil 4 in the radial direction, the strength of the anvil 4 can be maintained even though the recessed portion 37 is provided.

A small-diameter portion 38 is provided forward of the square-column portion 31. The small-diameter portion 38 is disposed at the front end of the anvil 4. An elastic body 39 (FIG. 1), which has a C-ring shape and serves to retain the socket 50, is held by the small-diameter portion 38.

To operate the impact wrench 1 configured as described above, the trigger 6 is pulled by a finger of the hand that holds (grasps) the handle 3. Thereupon, the switch 5 turns ON, and the brushless motor 11 operates (is energized) owing to the supply of electric power from the battery pack 10. Thereby, the rotary shaft 15 rotates, and the spindle 13 rotates at a reduced speed owing to the gear assembly of the speed-reducing mechanism 12. When the spindle 13 rotates, the hammer 17 is caused to rotate by the balls 19, which are rotated by the spindle 13. When the hammer 17 rotates, the anvil 4 rotates, and tightening of a bolt or the like by the socket 50 becomes possible.

As tightening progresses and the torque imparted to the anvil 4 becomes high, the hammer 17 retracts against the bias of the coil spring 18. That is, the hammer 17 retracts while the balls 19 are caused to respectively roll rearward along the cam grooves 20. Then, when the tabs 21 respectively separate from the arm portion 25, 25, the hammer 17 advances forward while rotating owing to the bias of the coil spring 18 and the guidance of the cam grooves 20. Thereby, the tabs 21 are caused to respectively reengage with (strike, impact) the corresponding arm portions 25, and thereby a rotational-impact force (impact) to the anvil 4 is generated. Further tightening is performed owing to the repetition of these impacts.

When an impact occurs, stress is generated in the square-column portion 31 owing to the collision between the square-column portion 31 of the anvil 4 and an inner surface of the square hole 51 of the socket 50. However, in the present embodiment, because the recessed portion 37 is formed between the cylindrical portion 30 and the enlarged portion 35, the anvil 4 takes on a form in which two shape-transition portions, i.e., the square-column portion 31 and the recessed portion 37, that sandwich the enlarged portion 35 are present. The shape of the recessed portion 37 is set such that the difference between the stress generated in the recessed portion 37 and the stress generated in the square-column portion 31 does not become large. Consequently, stress is distributed also to the recessed portion 37 without being concentrated in (at) the vicinity of the base of the square-column portion 31. As a result, breakage at the vicinity of the base of the square-column portion 31 tends not to occur.

A concrete example will now be explained, using numerical values as an example. For example, an example of the anvil 4 will be considered in which, referring to the reference symbols as shown in FIGS. 3A, 3C, 4A and 4B, the entire (overall) length L in the axial direction is 49.5 mm, the length L1 in the axial direction from the front surfaces of the arm portions 25 to the base of the square-column portion 31 is 24.5 mm, the outer diameter D of the cylindrical portion 30 is 18 mm, and the spacing S between the parallel side surfaces 32A, 32C of the square-column portion 31 is 12.7 mm.

In this concrete example, the recessed portion 37 is formed such that the radius r1 of the semicircular shape in a transverse cross section is 3.5 mm, the diameter d1 of the deepest portion is 13.4 mm, and the groove angle θ1 is 70°.

With these dimensions, an anvil 4 having the above-described recessed portion 37 and a conventionally shaped anvil having the same dimensional configuration but not having the recessed portion 37 were modelled, a moment of 400 Nm was applied to each model, and the stress that was generated at the base of the square-column portion 31 was analyzed.

As a result, compared with the conventionally shaped anvil not having the recessed portion 37, a stress reduction of approximately 10% was confirmed in the anvil 4 having the above-described recessed portion 37.

The impact wrench 1 according to the above-described first embodiment comprises: the brushless motor 11 (motor); the hammer 17, which is disposed frontward of the brushless motor 11 and rotates owing to the brushless motor 11; and a hammer case 16, which houses the hammer 17. In addition, the impact wrench 1 includes the anvil 4, which comprises: the arm portions 25, which are disposed frontward of the hammer 17 and are impacted (struck) in the rotational direction by the hammer 17; the cylindrical portion 30, which is connected to the arm portions 25 and is supported by the hammer case 16; the square-column portion 31 (socket-mating portion or square drive head), which is disposed forward of the cylindrical portion 30; and the enlarged portion 35, which is disposed between the cylindrical portion 30 and the square-column portion 31 and enlarges (widens) as it goes (extends) rearward from the square-column portion 31. Furthermore, the recessed portion (groove) 37, which is continuous in the circumferential direction of the cylindrical portion 30, is formed between the cylindrical portion 30 and the enlarged portion 35 of the anvil 4.

Owing to this configuration, less stress acts in the vicinity of the base of the square-column portion 31, and thereby the durability of the anvil 4 can be improved.

In particular, the recessed portion 37 has a semicircular shape in a transverse cross section. Thereby, a recessed portion 37 having a small (gentle, gradual) variation in shape can be formed, and thereby stress generated in the recessed portion 37 can be curtailed.

The diameter d1 of the deepest portion of the recessed portion 37 is smaller than the diameter of the circumscribed circle C of the square-column portion 31. Thereby, it is possible to obtain a recessed portion 37 that is effective in alleviating stress.

The diameter d1 of the deepest portion of the recessed portion 37 is larger than the spacing S between the side surfaces 32A, 32C of the square-column portion 31, which are parallel to each other. Thereby, the required strength can be ensured even though the recessed portion 37 is provided.

However, the diameter d1 of the recessed portion 37 may have a dimension that is the same as that of the spacing S or may have a dimension that is smaller than that of the spacing S.

In addition, the diameter d1 may be equal to the diameter of the circumscribed circle C or may be larger than the diameter of the circumscribed circle C.

Modified examples will be explained below.

In this regard, it is noted that the anvil according to the above-described first embodiment has one recessed portion that is formed between the cylindrical portion and the enlarged portion. However, in modifications of the first embodiment, a plurality of the recessed portions can be formed.

FIG. 5 to FIG. 7B show an anvil 4A according to a first modified example. With regard to the anvil 4A, two of the recessed portions, i.e., a first recessed portion (first circumferential groove) 37A and a second recessed portion (second circumferential groove) 37B, are formed (disposed) in the axial direction of the anvil 4A. Both of the recessed portions 37A, 37B have a semicircular shape in a transverse cross section, and their radii are set such that the radius r1 of the first recessed portion 37A is slightly larger than the radius r2 of the second recessed portion 37B. The widths of the first recessed portion 37A and the second recessed portion 37B in the axial direction are set such that they are substantially equal or are equal.

The recessed portions 37A, 37B overlap each other in the axial direction of the anvil 4A, and between them is formed a ring-shaped ridge 40, whose outer diameter is smaller than the outer diameter D of the cylindrical portion 30.

Figure 7A:
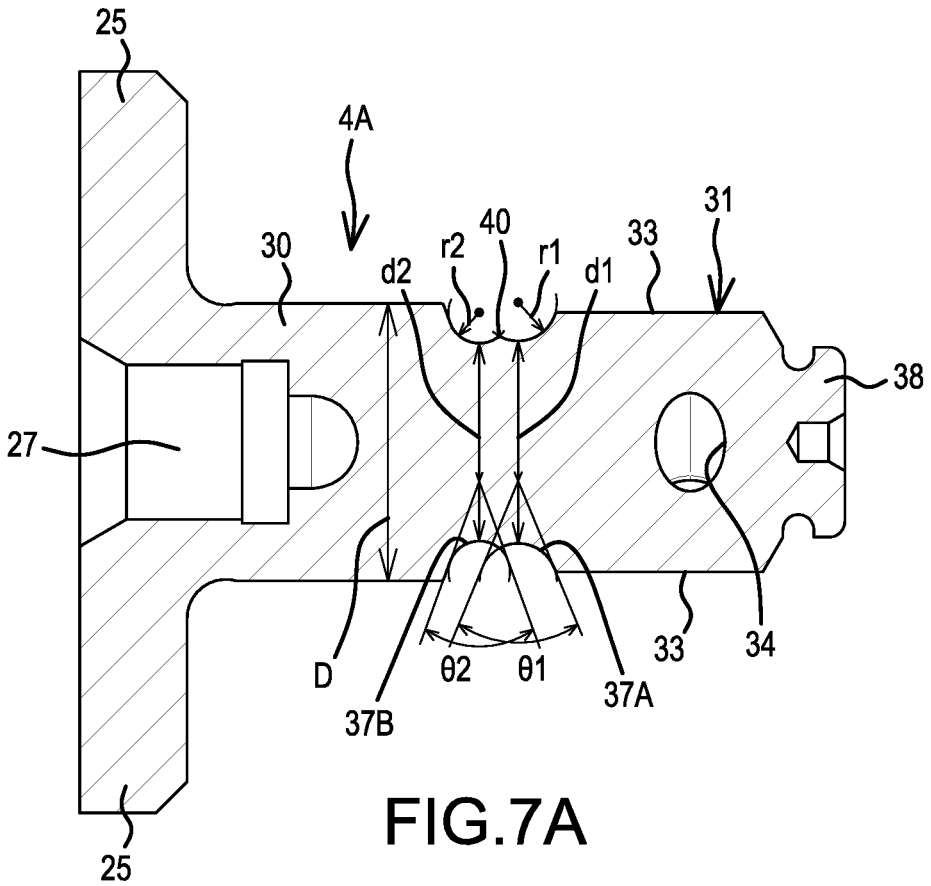
FIG. 7A is a cross-sectional view taken along line C-C in FIG. 6C.
Figure 7B:
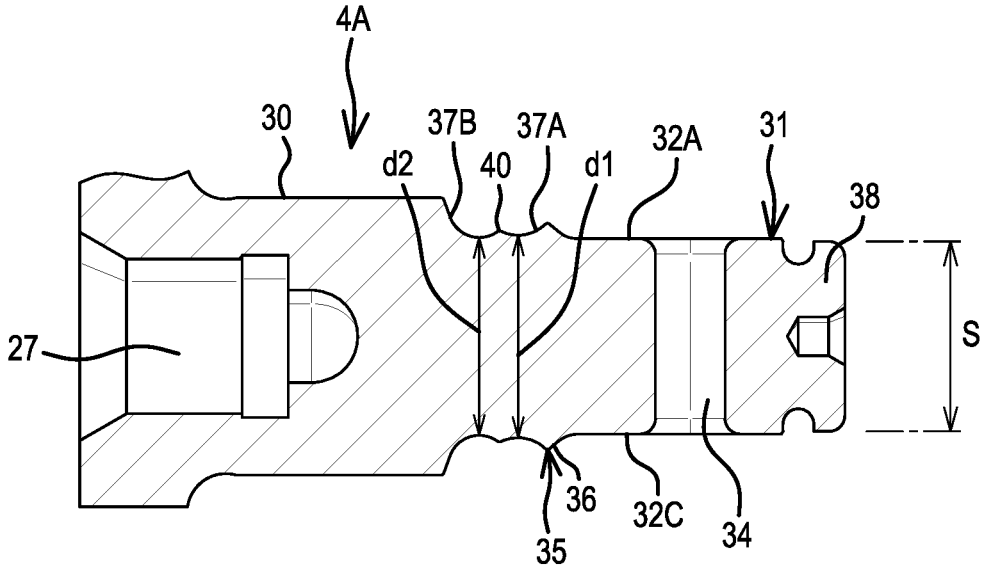
FIG. 7B is a cross-sectional view taken along line D-D.
Figure 8:
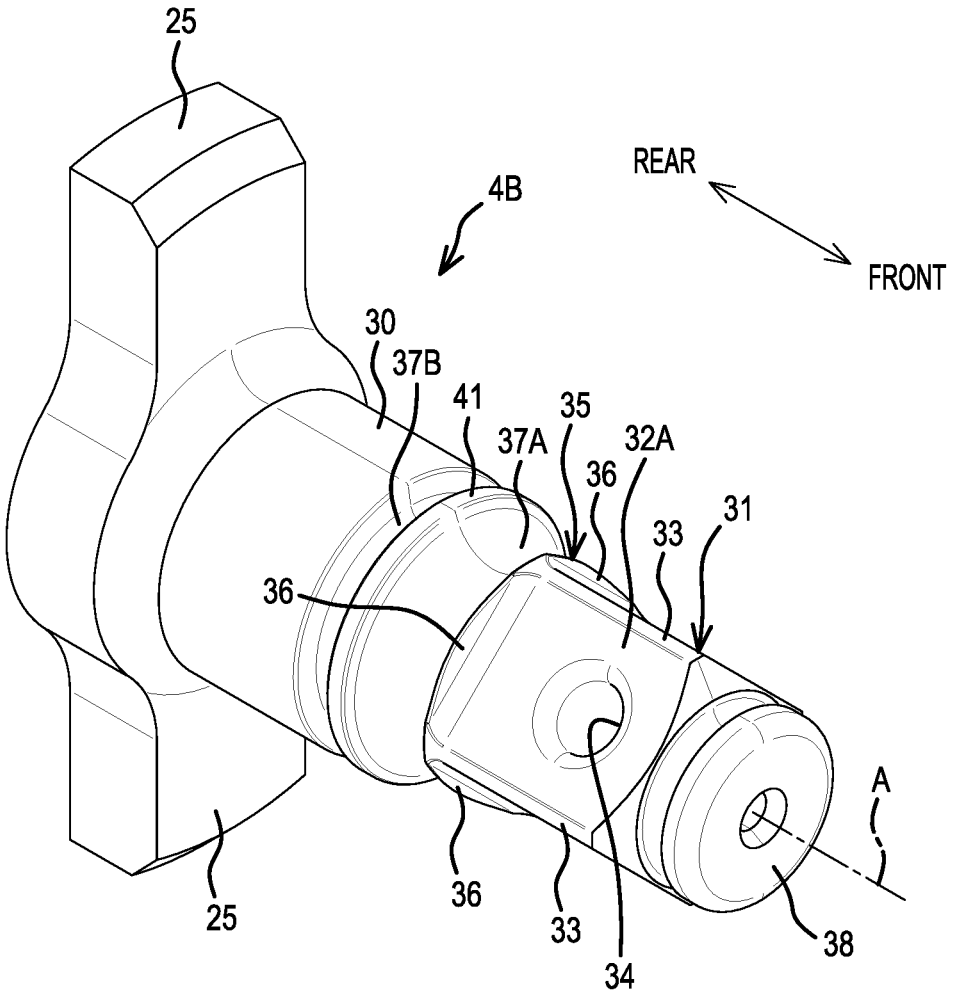
FIG. 8 is an oblique view of an anvil according to a second modified example.
Figure 9C:
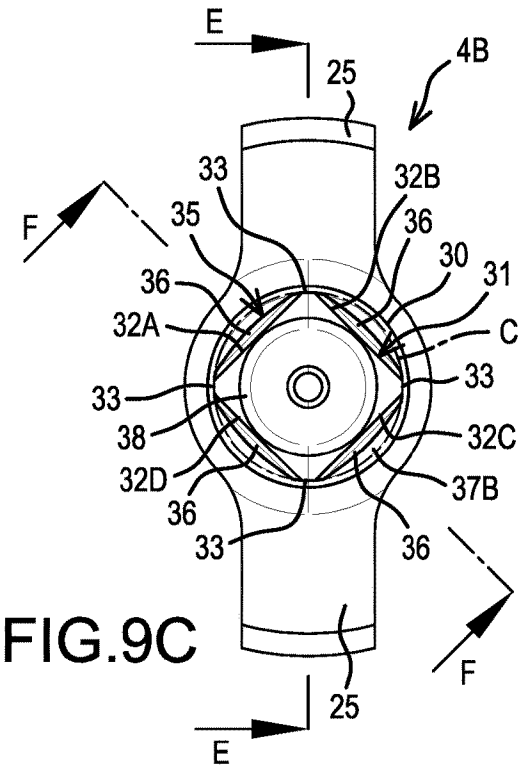
FIG. 9C is a front view thereof.
Figure 9B:
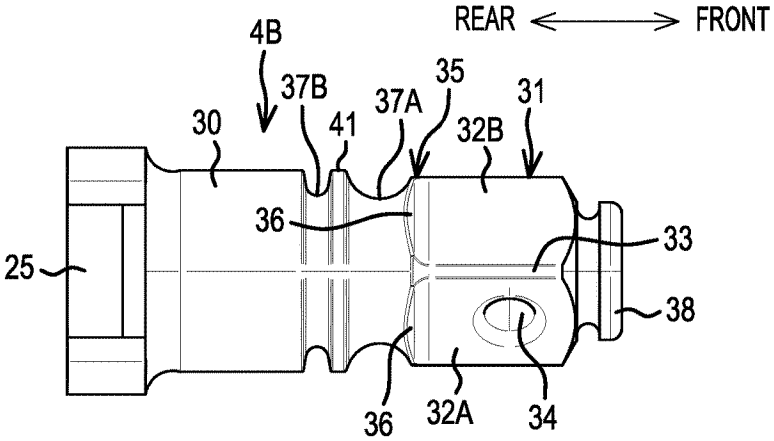
FIG. 9B is a plan view thereof.
Figure 9A:
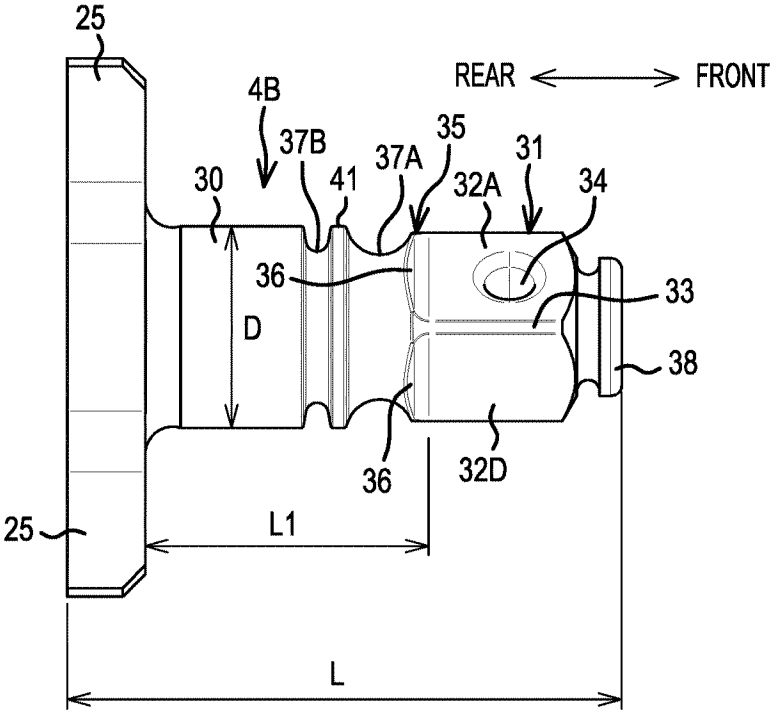
FIG. 9A is a side view of the anvil according to the second modified example.

The diameters of the deepest portions of the recessed portions 37A, 37B are set such that the diameter d1 of the first recessed portion 37A is slightly larger than the diameter d2 of the second recessed portion 37B. The diameters d1, d2 are each smaller than the diameter of the circumscribed circle C of the square-column portion 31. In addition, the diameters d1, d2 are each set such that they are larger than the spacing S between the side surfaces 32A, 32C of the square-column portion 31, which are parallel to each other, as can be seen in FIG. 7B.

In this first modified example as well, the stress generated in the anvil 4A is distributed to the square-column portion 31, the first recessed portion 37A, and the second recessed portion 37B, and does not concentrate in the vicinity of the base of the square-column portion 31. Thereby, less stress acts in the vicinity of the base of the square-column portion 31, and thereby the durability of the anvil 4A can be improved.

A concrete example will be explained, using numerical values as an example and with reference to FIG. 7A. A model of the anvil having the previously mentioned dimensional configuration was prepared, in which the radius r1 of the semicircular shape of the first recessed portion 37A was 2.5 mm, the radius r2 of the semicircular shape of the second recessed portion 37B was 2.0 mm, the diameter d1 of the deepest portion of the first recessed portion 37A was 13.1 mm, the diameter d2 of the deepest portion of the second recessed portion 37B was 12.8 mm, the length by which the recessed portions 37A, 37B overlapped one another in the axial direction was 2.5 mm, the groove angle θ1 of the first recessed portion 37A was 45°, and the groove angle θ2 of the second recessed portion 37B was 40°. Then, a moment of 400 Nm was applied to the model, and the stress generated at the base of the square-column portion 31 was analyzed.

As a result, it was determined that the anvil 4A having the first and second recessed portions 37A, 37B achieved a reduction in stress of approximately 15%, compared with the conventionally shaped anvil that does not have a recessed portion.

In the first modified example as well, the first recessed portion (first circumferential groove) 37A, which is continuous in the circumferential direction of the cylindrical portion 30, and the second recessed portion (second circumferential groove) 37B, which is disposed rearward of the first recessed portion 37A and is continuous in the circumferential direction of the cylindrical portion 30, are formed (disposed) between the cylindrical portion 30 and the square-column portion 31. Thereby, less stress is generated in the vicinity of the base of the square-column portion 31, and thereby the durability of the anvil 4 can be improved.

In particular, the ring-shaped ridge 40, whose diameter is smaller than the outer diameter D of the cylindrical portion 30, is formed (disposed) between the first recessed portion 37A and the second recessed portion 37B. Thereby, the recessed portions 37A, 37B take on a form in which they are coupled to one another, which leads to distribution of the stress.

The widths of the first recess 37A and the second recess 37B in the axial direction of the anvil 4 are the same. Thereby, distribution of the stress becomes uniform.

The enlarged portion 35, which enlarges (widens, flares) as it goes (extends) rearward from the square-column portion 31, is formed (disposed) between the first recessed portion 37A and the square-column portion 31. Thereby, the shape-transition portion of the square-column portion 31 and the shape-transition portion of the first recessed portion 37A can be clearly delimited, and thereby the stress-alleviation effect becomes high.

The first recessed portion 37A and the second recessed portion 37B each have a semicircular shape in a transverse cross section. Thereby, the first and second recessed portions 37A, 37B having small shape transitions can be formed, and thereby the stress generated in both of the recessed portions 37A, 37B can be curtailed.

The diameters d1, d2 of the deepest portions of the first recessed portion 37A and the second recessed portion 37B are each smaller than the diameter of the circumscribed circle C of the square-column portion 31. Thereby, the first and second recessed portions 37A, 37B, which are effective in alleviating stress, can be obtained.

The diameters d1, d2 of the deepest portions of the first recessed portion 37A and the second recessed portion 37B are each larger than the spacing S between the side surfaces 32A, 32C of the square-column portion 31, which are parallel to each other. Thereby, the required strength can be ensured even though the first and second recessed portions 37A, 37B are provided.

However, in the first modified example shown in FIG. 5 to FIG. 7B, the radii r1, r2 of the first and second recessed portions 37A, 37B may be set equal to one another. It also does not matter even if the widths of the first and second recessed portions 37A, 37B in the axial direction are equal.

The diameters d1, d2 may be set equal to one another. They may be set equal to the diameter of the circumscribed circle C or may be set larger than the diameter of the circumscribed circle C.

The diameters d1, d2 may be set to the same dimension as the spacing S or may be set to a dimension smaller than the spacing S.

FIG. 8 to FIG. 10B show an anvil 4B according to another (second) modified example. In the anvil 4B as well, two of the recessed portions, i.e., the first recessed portion (first circumferential groove) 37A and the second recessed portion (second circumferential groove) 37B, are formed (disposed) in the axial direction of the anvil 4B. However, the recessed portions 37A, 37B are formed such that the widths of the recessed portions 37A, 37B in the axial direction differ; in particular, the width of the first recessed portion 37A in the axial direction is larger than the width of the second recessed portion 37B in the axial direction. Thereby, the recessed portions 37A, 37B are formed such that the radii of the semicircular shapes of the recessed portions 37A, 37B in transverse cross section differ; in particular, the radius r1 of the first recessed portion 37A is larger than the radius r2 of the second recessed portion 37B.

Figure 10A:
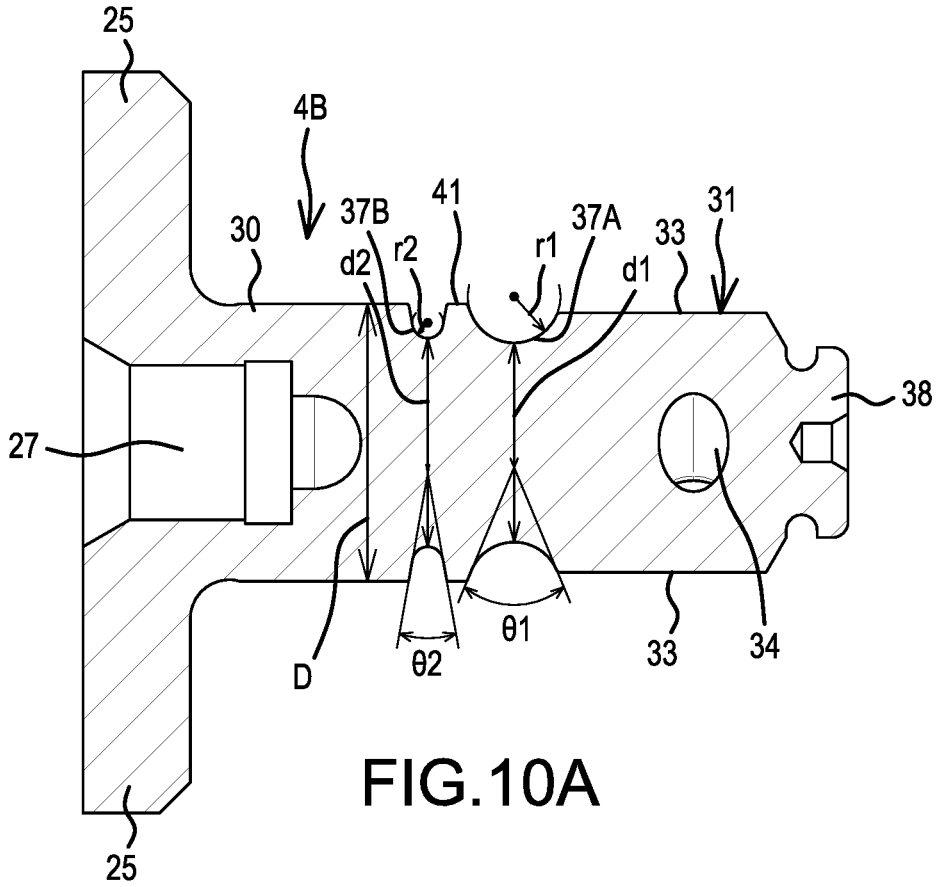
FIG. 10A is a cross-sectional view taken along line E-E in FIG. 9C.
Figure 10B:
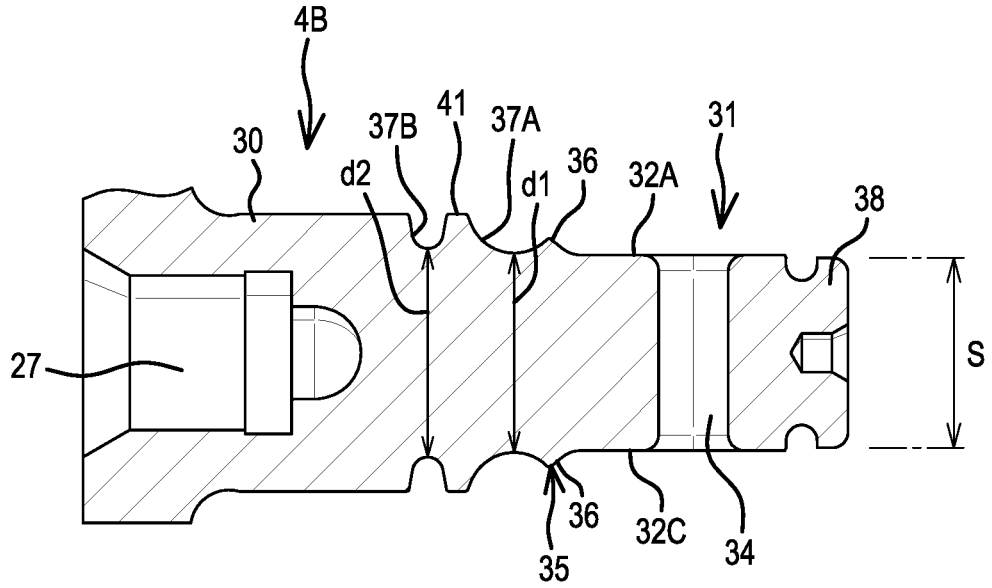
FIG. 10B is a cross-sectional view taken along line F-F.

In addition, the recessed portions 37A, 37B are separated (spaced apart) in the axial direction, and a ring-shaped ridge 41, whose diameter is the same as the outer diameter D of the cylindrical portion 30, is formed between the recessed portions 37A, 37B. The diameters of the deepest portions of the recessed portions 37A, 37B are set such that the diameter d1 of the first recessed portion 37A is slightly smaller than the diameter d2 of the second recessed portion 37B. The diameters d1, d2 are each smaller than the diameter of the circumscribed circle C of the square-column portion 31. In addition, the diameters d1, d2 are each larger than the spacing S between the parallel side surfaces 32A, 32C, as can be seen in FIG. 10B.

In this second modified example as well, the stress generated in the anvil 4B is distributed to the square-column portion 31, the first recessed portion 37A, and the second recessed portion 37B, and does not concentrate in the vicinity of the base of the square-column portion 31. Thereby, less stress acts in the vicinity of the base of the square-column portion 31, and thereby the durability of the anvil 4B can be improved.

A concrete example will be explained, using numerical values as an example and with reference to FIG. 10A. A model of the anvil having the previously mentioned dimensional configuration was prepared, in which the radius r1 of the semicircular shape of the first recessed portion 37A was 3.0 mm, the radius r2 of the semicircular shape of the second recessed portion 37B was 1.0 mm, the diameter d1 of the deepest portion of the first recessed portion 37A was 12.9 mm, the diameter d2 of the deepest portion of the second recessed portion 37B was 13.5 mm, the length of the ridge 41 in the axial direction was 1.3 mm, the groove angle θ1 of the first recessed portion 37A was 45°, and the groove angle θ2 of the second recessed portion 37B was 20°. Then, a moment of 400 Nm was applied to the model, and the stress generated at the base of the square-column portion 31 was analyzed.

As a result, it was determined that the anvil 4B having the first and second recessed portions 37A, 37B achieved a reduction in stress of approximately 12%, compared with the conventionally shaped anvil that does not have a recessed portion.

In this second modified example as well, the first recessed portion (first groove) 37A, which is continuous in the circumferential direction of the cylindrical portion 30, and the second recessed portion (second groove) 37B, which is disposed rearward of the first recessed portion 37A and is continuous in the circumferential direction of the cylindrical portion 30, are formed (disposed) between the cylindrical portion 30 and the square-column portion 31. Thereby, less stress acts in the vicinity of the base of the square-column portion 31, and thereby the durability of the anvil 4 can be improved.

In particular, the ring-shaped ridge 41, whose diameter is the same as the outer diameter D of the cylindrical portion 30, is formed (disposed) between the first recessed portion 37A and the second recessed portion 37B. Thereby, sufficient strength in the vicinity of the recessed portions 37A, 37B can be ensured.

The widths of the first recessed portion 37A and the second recessed portion 37B in the axial direction of the anvil 4 differ. Thereby, a sufficient length of the cylindrical portion 30 in the axial direction can be ensured even though a plurality of the recessed portions is provided.

However, in the modified example shown in FIG. 8 to FIG. 10B, the diameters d1, d2 of the first and second recessed portions 37A, 37B may be set equal to one another or may be set such that the diameter d1 is larger than the diameter d2.

The diameters d1, d2 may each be set equal to the diameter of the circumscribed circle C or may each be set larger than the diameter of the circumscribed circle C.

The diameters d1, d2 may be set to the same dimension as the spacing S or may be set to a dimension smaller than the spacing S.

Modified examples in common with the above-mentioned examples will be explained below.

The shape of the recessed portion(s) is (are) not limited to the above-mentioned examples and can be modified as appropriate. The number of the recessed portions can also be three or more.

The transverse-cross-sectional shape(s) of the recessed portion(s) is (are) not limited to a semicircular shape and may be a semielliptical shape, a V shape, or the like. However, because stress concentrates when the shape transition becomes large, as in a V shape, a shape is preferable in which the shape transition is gentle or gradual (i.e. not abrupt or sharp), such as a semicircular shape, a semielliptical shape, or the like.

The enlarged portion is not limited to consisting of four tongues extending from the side surfaces of a square-column portion. For example, the enlarged portion may be configured as a ring-shaped flared portion (tapered portion) in which the rear end is a circular shape that straddles the spaces between the four tongues in the circumferential direction.

The shapes of the square-column portion, the cylindrical portion, and the arm portions are also modifiable. The square-column portion does not have to have a through hole. In addition, the small-diameter portion also does not have to be formed.

The socket-mating portion is not limited to a square-column portion, and some other shape can also be used. For example, a column portion having some other polygonal shape, such as a hexagonal column, an octagonal column, or the like, may be used. The point is that it should be capable of mating, in the rotationally locked state (i.e. a form-fit or shape-fit manner), to (with) a substantially regular polygonal hole in which the socket is provided.

In addition, the motor does not have to be brushless. It may be an AC motor (e.g., commutated motor) that receives an AC power supply from a commercial power supply; i.e. the impact wrench does not use a battery pack.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved impact wrenches.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EXPLANATION OF THE REFERENCE NUMBERS

1 Impact wrench
2 Main body
3 Handle
4, 4A, 4B Anvils
11 Brushless motor
13 Spindle
14 Impact mechanism
15 Rotary shaft
16 Hammer case
17 Hammer
25 Arm portion
30 Cylindrical portion
31 Square-column portion (socket mating portion)
32A-32D Side surfaces
35 Enlarged portion
36 Tongue
37 Recessed portion (first circumferential groove)
37A First recessed portion (first circumferential groove)
37B Second recessed portion (second circumferential groove)
40, 41 Ridges
50 Socket
A Axis of anvil
D Outer diameter of cylindrical portion
d1, d2 Diameters of deepest portions of recessed portions
r1, r2 Radii of transverse, cross-sectional, semicircular shape of recessed portions
C Circumscribed circle of square-column portion
S Spacing between parallel side surfaces
θ1, θ2 Groove angles

The invention claimed is:

1. An impact wrench, comprising:
a motor;
a hammer disposed frontward of the motor and configured to be rotated in response to the motor being energized;
a hammer case, which houses the hammer; and
an anvil comprising: an arm portion disposed frontward of the hammer and configured to be impacted in a rotational direction by the hammer; a cylindrical portion connected to the arm portion and supported by the hammer case; a socket-mating portion disposed frontward of the cylindrical portion; and an enlarged portion comprising a plurality of radially outwardly flared tongues each having a front surface and a rear surface disposed between the cylindrical portion and the socket-mating portion;
wherein an outer dimension of the enlarged portion enlarges in a direction extending rearward from the socket-mating portion;
the anvil has a continuous ring-shaped channel disposed between the cylindrical portion and the socket-mating portion of the anvil; and
the rear surface of each of the flared tongues defines a front portion of the continuous ring-shaped channel.

2. The impact wrench according to claim 1, wherein the continuous ring-shaped channel has a semicircular shape in a transverse cross section.

3. The impact wrench according to claim 1, wherein a deepest portion of the continuous ring-shaped channel has a diameter that is smaller than the diameter of a circumscribed circle of the socket-mating portion.

4. The impact wrench according to claim 1, wherein:
the socket-mating portion is a square-column portion; and
a deepest portion of the continuous ring-shaped channel has a diameter that is larger than a spacing between side surfaces of the square-column portion that are parallel to each other.

5. The impact wrench according to claim 4, wherein:
the continuous ring-shaped channel has a semicircular shape in a transverse cross section; and
the diameter of the deepest portion of the continuous ring-shaped channel is smaller than the diameter of a circumscribed circle of the socket-mating portion.

6. An impact wrench, comprising:
a motor;
a hammer disposed frontward of the motor and configured to be rotated in response to the motor being energized;
a hammer case, which houses the hammer; and
an anvil comprising: an arm portion disposed frontward of the hammer and configured to be impacted in a rotational direction by the hammer; a cylindrical portion connected to the arm portion and supported by the hammer case; a socket-mating portion disposed frontward of the cylindrical portion; and an enlarged portion comprising a plurality of radially outwardly flared tongues disposed between the cylindrical portion and the socket-mating portion;
wherein:
each of the flared tongues has a front surface and a rear surface;
the anvil has a first continuous ring-shaped channel and a second continuous ring-shaped channel disposed between the cylindrical portion and the socket-mating portion of the anvil; and
the second continuous ring-shaped channel is disposed rearward of the first continuous ring-shaped channel; and
the rear surface of each of the flared tongues defines a front portion of the first continuous ring-shaped channel.

7. An impact wrench, comprising:
a motor;
a hammer disposed frontward of the motor and configured to be rotated in response to the motor being energized;
a hammer case, which houses the hammer; and
an anvil comprising: an arm portion disposed frontward of the hammer and configured to be impacted in a rotational direction by the hammer; a cylindrical portion connected to the arm portion and supported by the hammer case; and a socket-mating portion disposed frontward of the cylindrical portion;
wherein:
the anvil has a first ring-shaped channel and a second ring-shaped channel disposed between the cylindrical portion and the socket-mating portion of the anvil;

the second ring-shaped channel is disposed rearward of the first ring-shaped channel;

the first and second ring-shaped channels are each continuous in a circumferential direction of the cylindrical portion;

a ring-shaped ridge is disposed on the anvil between the first ring-shaped channel and the second ring-shaped channel; and the ring-shaped ridge has a diameter that is smaller than an outer diameter of the cylindrical portion.

8. The impact wrench according to claim 6, further comprising:

a ring-shaped ridge disposed on the anvil between the first continuous ring-shaped channel and the second continuous ring-shaped channel;

wherein the ring-shaped ridge has a diameter that is the same as an outer diameter of the cylindrical portion.

9. The impact wrench according to claim 6, wherein:

the first continuous ring-shaped channel has a first width in an axial direction of the anvil;

the second continuous ring-shaped channel has a second width in the axial direction of the anvil;

the first width equals the second width.

10. The impact wrench according to claim 6, wherein:

the first continuous ring-shaped channel has a first width in an axial direction of the anvil, the second continuous ring-shaped channel has a second width in the axial direction of the anvil, the first width is not equal to the second width.

11. The impact wrench according to claim 6, further comprising:

an enlarged portion disposed between the first continuous ring-shaped channel and the socket-mating portion;

wherein an outer dimension of the enlarged portion enlarges in a direction extending rearward from the socket-mating portion.

12. The impact wrench according to claim 6, wherein the first continuous ring-shaped channel and the second continuous ring-shaped channel each have a semicircular shape in a transverse cross section.

13. The impact wrench according to claim 6, wherein:

a deepest portion of the first continuous ring-shaped channel has a first diameter;

a deepest portion of the second continuous ring-shaped channel has a second diameter that is equal to or different from the first diameter; and both the first diameter and the second diameter are smaller than the diameter of a circumscribed circle of the socket-mating portion.

14. The impact wrench according to claim 6, wherein:

the socket-mating portion is a square-column portion;

a deepest portion of the first continuous ring-shaped channel has a first diameter;

a deepest portion of the second continuous ring-shaped channel has a second diameter that is equal to or different from the first diameter; and both the first diameter and the second diameter are larger than a spacing between side surfaces of the square-column portion that are parallel to each other.

15. The impact wrench according to claim 1, wherein the front surface of each of the flared tongues is concave.

16. The impact wrench according to claim 15, wherein:

the socket-mating portion has a square cross section with chamfered edges; and wherein the chamfered edges extend to the ring-shaped channel.

17. The impact wrench according to claim 1, wherein an outermost periphery of the enlarged portion includes a plurality of lobes.

18. The impact wrench according to claim 6, further comprising:

a ring-shaped ridge disposed on the anvil between the first ring-shaped channel and the second ring-shaped channel, wherein the ring-shaped ridge has a diameter that is smaller than an outer diameter of the cylindrical portion.

19. The impact wrench according to claim 7, wherein:

the anvil includes a plurality of radially outwardly flared tongues between the cylindrical portion and the socket-mating portion, each of the flared tongues includes a front surface and a rear surface, and a rear side of each of the flared tongues defines a front portion of the first ring-shaped channel.

20. The impact wrench according to claim 19, wherein the front surface of each of the flared tongues is concave.

* * * * *